US005740968A

United States Patent [19]

Mueller

[11] Patent Number: 5,740,968

[45] Date of Patent: Apr. 21, 1998

[54] INDUSTRIAL WASHDOWN GUN

[76] Inventor: Theodore H. Mueller, 128 Turkey Run Rd., Cary, Ill. 60013

[21] Appl. No.: 638,357

[22] Filed: Apr. 26, 1996

[51] Int. Cl.[6] ..... B05B 9/01

[52] U.S. Cl. ..... 239/526; 239/583; 239/600

[58] Field of Search ..... 239/443, 525, 239/526, 530, 569, 583, 600

[56] References Cited

U.S. PATENT DOCUMENTS

| | | | |
|---|---|---|---|
| 2,448,159 | 8/1948 | Spreng | 239/583 X |
| 3,670,967 | 6/1972 | Fahlin et al. | 239/525 X |
| 4,541,568 | 9/1985 | Lichfield | 239/526 X |
| 4,776,517 | 10/1988 | Heren | 239/526 X |
| 5,094,402 | 3/1992 | Perret, Jr. et al. | 239/600 X |
| 5,176,327 | 1/1993 | Petersen et al. | 239/525 X |

OTHER PUBLICATIONS

Brochure from Straham Valves, Inc., Florham Park, NJ, "Straham Automatic Water-Saver Spray Nozzle", 2 pages.

Catalog Page from McMaster-Carr Industrial Supply Co., "Spray Guns & Nozzles", 1 page (1197).

Brochure from Spraying Systems Co., Wheaton, Illinois, "GunJet", 4 pages.

Brochure from H.D. Hudson Manufacturing Company, Chicago, Illinois, Green Garde® JD9-C™ High Pressure Spray Gun, 1991, 4 pages.

Brochure from Melnor Inc., Moonachie, NJ, "Melnor Multi-Purpose Industrial Aqua-Gun® Nozzle", 1 page.

*Primary Examiner*—Andres Kashnikow
*Assistant Examiner*—Steven J. Ganey
*Attorney, Agent, or Firm*—James T. Fitzgibbon

[57] ABSTRACT

A high pressure industrial washdown gun. The gun comprises a body having a hand grip portion, a trigger, a flow control valving system and a conduit for directing the water to the interior of the gun body. The valving system includes a containment sleeve, a connector, a nozzle assembly, a valving rod, and a central water flow passage extending therethrough. A tapered seat surrounds the flow passage. The valving rod includes a nose portion, an enlarged diameter head, and an elongated stem. The valving rod slides within a guide which positions it relative to the containment sleeve. A return spring is provided for the valving rod.

10 Claims, 3 Drawing Sheets

INDUSTRIAL WASHDOWN GUN

BACKGROUND OF THE INVENTION

The present invention relates generally to liquid flow control guns and more particularly what are termed industrial washdown guns.

Guns of the sort with which the invention are concerned are customarily used in industry, and particularly in the food and beverage industry, where there is an ongoing requirement to maintain sanitary conditions and a clean environment during food and beverage processing, storage, packaging or the like.

Because of the nature of the processing being carried out, a major portion of the equipment is made from a food grade stainless steel or the like and the floors, wall, and other surfaces in the rooms are finished with non-porous easily cleanable materials such as tile, epoxy coating or the like. The normally preferred method of cleaning the facilities, both periodically during use and at scheduled maintenance intervals, is to direct patterns of pressurized water onto the articles and surfaces to dislodge and rinse away all soiling and foreign materials. The effectiveness of the water improves with increased water pressure and temperature and sometimes with the addition of active chemicals to the water supply. Most commonly, the water is supplied to the gun and directed to a target area as a high velocity concentrate, stream or a broad spray pattern. The concentrated stream is best for dislodging residue and scouring surfaces while the broad spray enables the worker to cover large areas for general cleaning and rinsing. For this purpose, water may be delivered to the gun at pressures of 50 to 300 psi or more and temperatures up to and sometimes exceeding 180° F. The flow rate through guns is typically 10 to 15 gpm. In some cases, the water may contain chemicals of various sorts, such as detergents, disinfectants, or the like as may be required by the contingencies of the process in question.

Industrial washdown guns known to the applicant to be in common use have not changed substantially in design or execution for many years. Although originally designed for heavy duty use, and to provide certain advantages, most or all of the existing washdown guns suffer from several relatively serious shortcomings of increasingly well-recognized importance. By way of example, as employers, government agencies, and others who are concerned with the health and welfare of workers continue their studies, it has become apparent that many employee injuries, particularly chronic injuries, result from equipment that is improperly designed, unduly heavy, unwieldy, or requires awkward positioning of the hands and arms for use.

In many cases, washdown guns of the prior art have in fact been unduly heavy, and have had other drawbacks rendering them unsatisfactory, particularly as regards the health and welfare of workers. It is also known that, if industrial equipment is difficult or dangerous to manipulate, there is an increasing likelihood that the employee might not do as thorough and careful a job is expected of him or her. In this connection, it is realized that it is to the benefit of both employers and employees to adopt and utilize equipment which is designed for and capable of providing advantageous conditions for the user.

Many, if not all, prior art industrial washdown guns are extremely heavy, approximating 3 to 4 lbs. for the gun alone, that is, exclusive of the weight of the water-filled hose to which the gun is attached.

As has been discovered recently in connection with what are now termed repetitive stress injuries or the like, the position the hands and wrists must assume when manipulating equipment bears strongly on the length of time during which such equipment may be manipulated without risking injury or creation of a chronic condition. Many prior art guns are ergonomically unsound and require the wrist to be forced into a non-neutral or stress position in order to actuate the gun. This becomes more crucial as the length of time required to achieve a washdown cycle increases. Many of the above described injuries, particularly hand and wrist injuries, result from the use of return springs which are unduly strong and which require great effort to overcome.

The most commonly used prior art guns do not provide thermal insulation between the handle and the water supply or other portions of the gun in heat exchange contact with the handle. Thus, the handles of some prior art guns, even those with an outer rubber sleeve, may achieve surface temperatures of up to 150° F. or more, for example. Several commonly available industrial washdown guns use a rear-mounted trigger, which is awkward and difficult to manipulate in use, and some such guns have only a very long trigger rather than providing a choice of triggers. Prior art guns generally have had no shield or guard to protect the trigger from damage when the gun is dropped onto or dragged along the floor by the hose. An ideal gun would provide an improved trigger arrangement including a trigger guard and a stay or lock which has not previously been available.

Needless to say, safety is of major importance in any industrial process, and prior art designs that do not differentiate between front and rear raise the possibility that a user might spray himself instead of the work, possibly suffering a serious injury. With a rear trigger gun, this is a genuine risk that should be addressed.

Several known prior art guns have features which, although theoretically advantageous, have in practice proven to be unsatisfactory. Prior art guns, because of their valve design and constructions, require internal adjustment and settings to be made so that the gun in operation will provide the full range of desirable flow patterns from broad spray to narrow stream. Thus, in ideal gun is one that provides the desired flow patterns without the need for internal adjustment to achieve them.

In an attempt to achieve thermal insulation, some prior art industrial washdown guns have been manufactured from metal and then covered with a rubber jacket which is difficult to remove and replace. Hence, maintenance, including repair and replacement of parts, is expensive and time consuming. In an ideal gun, maintenance may be performed using the hands or simple hand tools only, with no requirement that adjustments be performed or that high forces be applied to remove and replace parts of the apparatus. Because guns of the invention are used at high pressures, it is also a practical requirement that fluid seals be relatively foolproof and also be capable of easy repair and/or replacement if this requirement arises. Because of the need for safety and for universal application, the ideal gun would be able to achieve a pressure rating of at least 300 psi.

The prior art having failed to provide an industrial washdown gun having the combination of advantages and characteristics referred to herein, and other advantages as well, it is an object of the present invention to provide an improved industrial washdown gun.

Another object of the present invention is to provide an industrial washdown gun that is lighter and easier to control than other guns made for the same purpose.

Yet another object of the present invention is to provide a gun in which the components may be disassembled using only hand tools and having other components which may be assembled and disassembled using only the hands of the operator or maintenance personnel.

A further object of the present invention is to provide a gun which is capable of handling high temperature water, but which also inherently provides excellent thermal insulation to provide enhanced comfort and safety for the user.

A still further object of the invention is to provide a gun having a front trigger and a trigger assembly which is constructed and arranged for a neutral wrist positioning during aiming and discharging the gun.

An additional object of the invention is to provide a gun wherein the arrangement of the valving components is such that the primary seal is foolproof and yet easily replaced if needed.

A further object of the invention is to provide a gun which will operate reliably and with moderate trigger forces at pressures up to or exceeding 300 psi.

Another object of the invention is to provide a washdown gun wherein the water pressure within the gun does not substantially bias the valve to an either open or closed position but which is relatively neutral in response to pressure.

Yet another object of the invention is to provide a gun wherein the valve components are made of durable yet easily replaceable materials.

A further object of the invention is to provide a construction wherein the moving parts are able to be precisely aligned and maintained in such positions of alignment without creating undue friction or wear.

The invention achieves its objects and other inherent objects and advantages by providing a gun with a body and an interior valving system including an inlet conduit, an exterior containment sleeve, a nozzle with a tapered seat and center passage and a valving rod having a valve head with portions engaging the tapered nozzle seat, a valve stem guide positioning the valving rod in a trigger operatively connected to a portion of the valve stem and a gun handle with an interior insulating space to prevent heat transfer from the conduit to the gun handle.

The exact manner in which the foregoing and other objects and advantages of the invention are achieved in practice will become more clearly apparent when reference is made to the following detailed description of the preferred embodiments of the invention set forth by way of example and shown in the accompanying drawings, in which like reference numbers indicate corresponding parts throughout.

DESCRIPTION OF THE PREFERRED EMBODIMENTS OF THE INVENTION

While the inventive concept is capable of being embodied in different forms, a detailed description will be given herein of a presently preferred form of inventive gun, showing a number of the components of the gun that have proven to provide a number of advantages in use.

Figure 1:
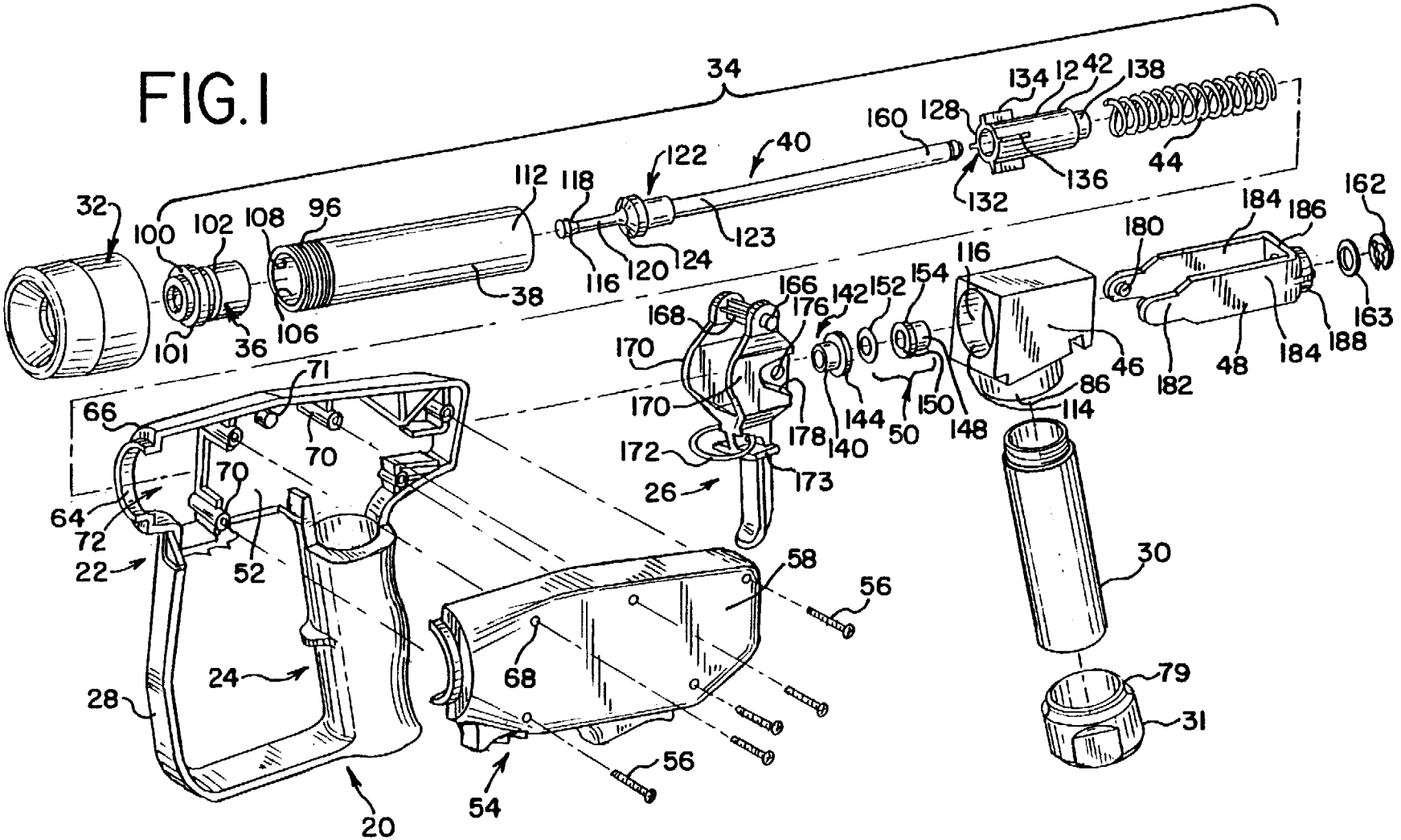
FIG. 1 is an exploded perspective view of the high pressure washdown gun of the invention, showing the principal components thereof.
Figure 2:
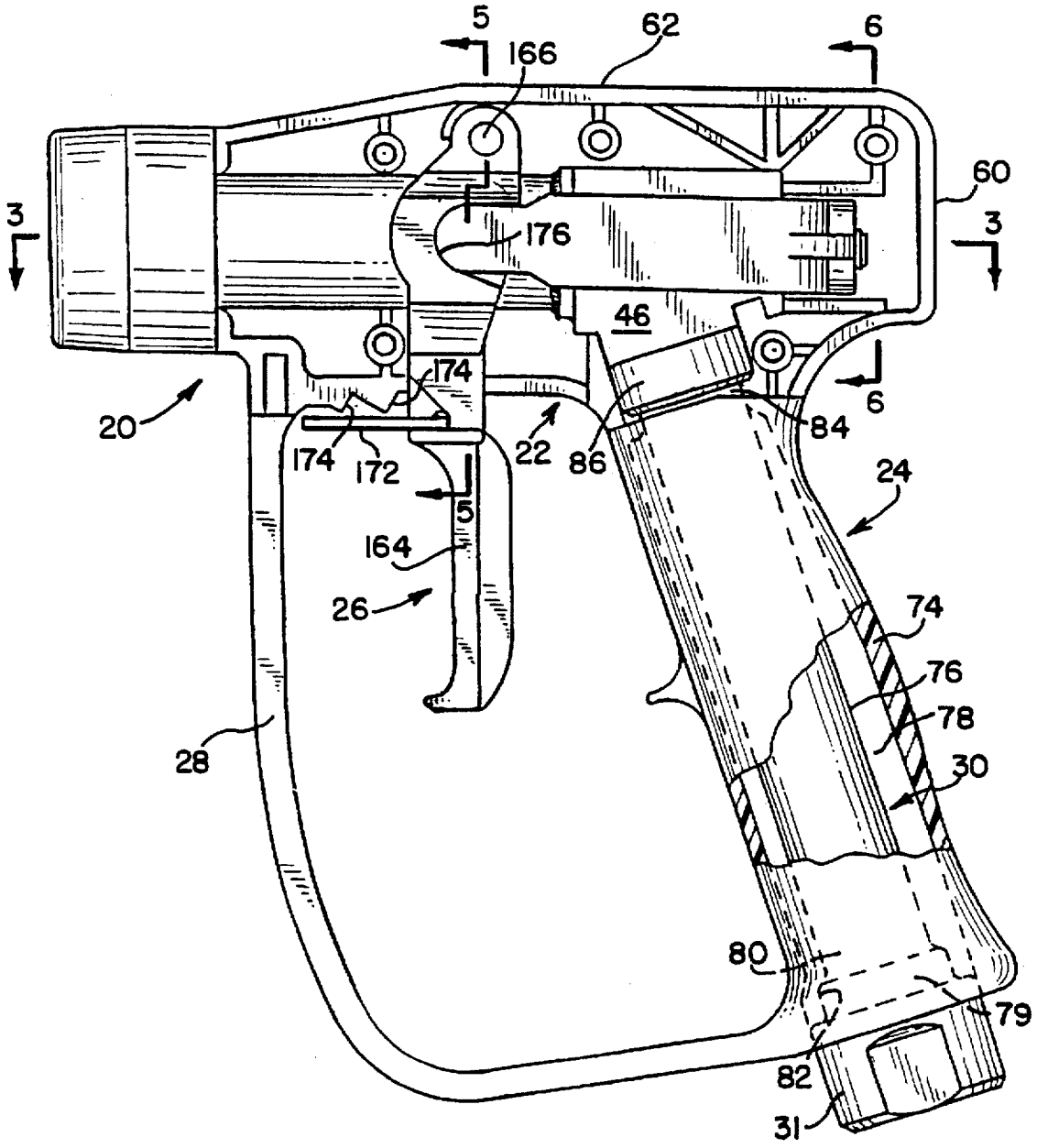
FIG. 2 is an enlarged side elevational view, with portions in section, of the gun of FIG. 1, showing the same with the housing cover removed.

Referring now to the drawings in greater detail, FIGS. 1 and 2 show an industrial washdown gun generally designated 20, and illustrate a number of its principal components. These components include a gun body generally designated 22, a hand grip portion generally designated 24 and a trigger assembly generally designated 26. The body 22 and integrally formed hand grip 24 are connected by a trigger guard 28 extending between the forward portion of the gun body 22 and the lower end of the hand grip 24. As used herein, the expression "forward" or words of like import referred to the end of the gun toward the nozzle; expressions such as upper, top, or the like refer to those portions of the gun in its normal position of use with the hand grip extending downwardly from the body.

As shown, a water conduit generally designated 30 is shown to be positioned with the hand grip 24, and to terminate in a lower female fitting 31 for receiving a counterpart male fitting (not shown) on the end of a water supply hose in a manner known to those skilled in this art.

Referring again to the drawings, and in particular to FIG. 1, a number of additional individual components of the gun 20 are shown. Here, and beginning at the forward end of the gun, are shown a nozzle cover generally designated 32, the construction and operation of which is detailed elsewhere herein. A novel valving system, generally designated 34, includes a plurality of components including a nozzle and valve seat unit 36, a water impermeable containment sleeve 38, an elongated valving rod generally designated 40, a valve stem guide 42, return spring means in the form of a coil spring 44, a connector 46 for attachment respectively to the containment sleeve 38 and the water conduit 30.

In the preferred form of apparatus, means for connecting the valving rod 40 to the trigger 26 are present in the form of a yoke 48. A seal assembly generally designated 50 is shown to include plural individual components described elsewhere herein for sealing the space between a portion of the valve stem and the connector so as to avoid leakage between these components.

Referring again to FIGS. 1 and 2, the operative portions of the gun, including the valving system, are received within a main housing 52 and a readily removable housing cover generally designated 54 and secured together by plural screws or like fasteners 56. The main housing 52 is of conventional shape for a gun and includes a pair of substantially identical side surfaces 58 (the one forming a major portion of the cover 54 being the only surface shown), rear surfaces 60, top surfaces 62, and a reduced diameter, forwardly extending neck, 64 offset by a shoulder 66 from the remainder of the housing 52. In the preferred form, the housing cover 54 includes plural fastener openings 68, while counterpart screw-receiving bosses 70 are positioned in spaced apart locations inside the main housing 52 in alignment with the openings 68.

In the preferred form, the main housing and cover are made from tough, resilient molded plastics, and the fasteners 56 are self tapping screws capable of forming threaded portions in the bosses 70. In addition, both the main housing 52 and the cover 54 include a relatively short trigger pin boss 71. An opening 72 is formed inside the collar 64 to allow selected portions of the valving system 34 to protrude therethrough, as will be described.

Referring now in particular to FIG. 2, it will be noted that the hand grip generally designated 24 includes wall portions 74 spaced apart from the outer wall 76 of the water conduit 30 so as to provide an insulated air space 78 between these components. The fitting 31 on the lower end 80 of the conduit includes an insert portion 79 positioned within a locating counterbore 82 in the base of the hand grip 24, thus positively locating the conduit and preventing it from contacting the wall 74 of the grip 24.

According to the preferred form of apparatus, the upper end portion 84 of the water conduit 30 is threadedly received in a tapped collar portion 86 of the connector 46.

Figure 3:
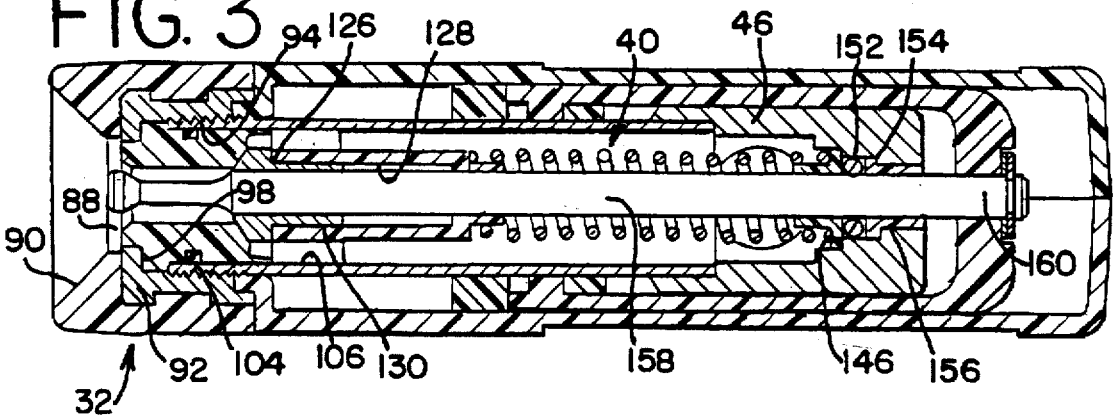
FIG. 3 is a horizontal sectional view of the valving system of the gun of FIGS. 1 and 2, taken along lines 3—3 of FIG. 2 and showing the valving rod in the closed position.

Referring now to the construction and operation of the main components of the valving system 34, by reference to FIGS. 1 and 3, it will be noted that the nozzle cover 32 includes a center opening 88 lying inwardly of a tapered annular outlet-forming surface 90. The nozzle cover is preferably molded or otherwise formed so that a stiffener 92, preferably made from brass, forms an integral part thereof. Internal threads 94 on the stiffener 92 allow the nozzle cover 32 to be snugly positioned over the threaded end portion 96 of the containment sleeve 38. A shoulder 98 on the stiffener 92 engages the outer end face 100 on a flange 101 the nozzle unit 36, retaining the nozzle inside the sleeve 38.

Figure 4:
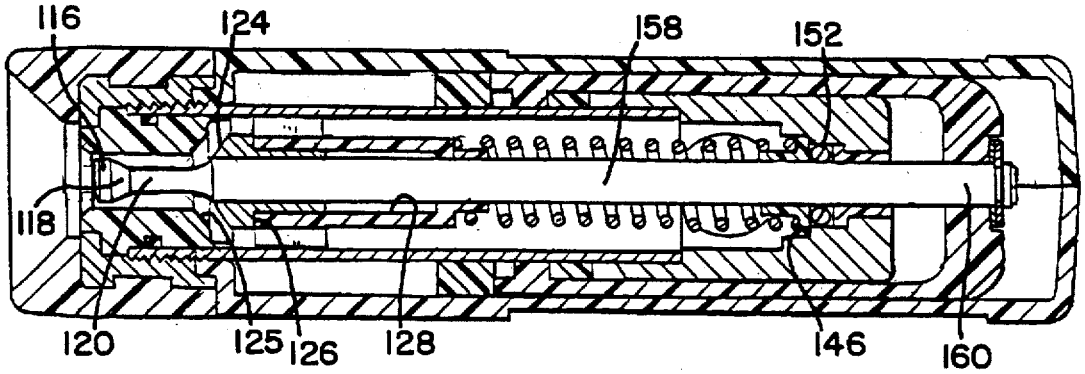
FIG. 4 is a view similar to that of FIG. 3 but showing the valving rod and its associated elements in the open position of the valve.
Figure 5:
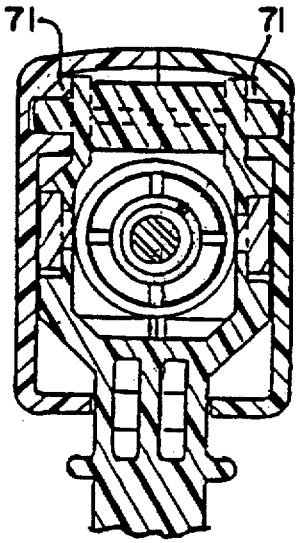
FIG. 5 is a fragmentary vertical sectional view showing the location of certain components of the trigger system of the gun of FIG. 2, taken along lines 5—5 thereof.

The nozzle unit 36 in turn further includes a groove 102 for receiving and positioning an O-ring 104 (FIGS. 3 and 4) that provides a liquid-tight seal between the body of the nozzle 36 and the inner surface 106 of the sleeve 38. Thus, when these parts are to be assembled, the nozzle 36 is pushed with a light force into the end opening 108 in the sleeve 38, until the inner end face surface portion 102 of the flange 101 engages the sleeve end wall. At this point, there is a snug fit between the O-ring 104 and the inner surface 106. Thereafter, the nozzle cover 32, including its integral insert 92 are hand tightened until these parts are held together in a snug, water-tight, but manually removable relation.

As shown in FIGS. 1–4, the opposite or rear end portion 112 of the containment sleeve is welded onto the surfaces 114 defining the outlet end 116 of the connector 46.

Referring now to another component, the valving rod generally designated 40 includes an outer stream- or pattern-forming flow control surface 116, on a contoured nose 118 situated at the end of a reduced diameter rod extension 120. In further keeping with the invention, the valving rod also includes a valve head generally designated 122 that includes an annular frustoconical sealing surface 124 (FIGS. 1 and 4), that mates with the tapered annular valve seat surface 125 on the nozzle and valve seat unit 36.

A rear portion of the valve head 122 includes an outer cylindrical surface 123 and a seating shoulder 126 for the valve stem guide 42.

According to the invention, the inner diameter surfaces 128 of the valve stem guide 42 in the form of a spider overlying the outer cylindrical surface 123 on the inner end of the valve head 122. The valve stem guide or spider 42, in addition to the center passage generally designated 132 formed by the surface 128, includes a plurality of radial locating ribs 134 having their outer end surfaces 136 engaged in snug but low friction sliding relation to the inside diameter 106 of the sleeve 38. A reduced diameter shank portion 138 on the guide 42 aids in positioning an outer end portion of the trigger return coil spring 44. The opposite end of the spring 44 is received over the shank portion 140 of a spring seat generally designated 142 and shown to include a radial flange 144, the rear surface of which engages a counterbore end face 146 within the body of the connector 46. A seal assembly generally designated 50 (FIG. 1) includes a flanged O-ring positioner 148 having an end face 150 that engages an O-ring 152 entrapped between the flange 144 of the spring seat 142 and the end face 150 of the positioner 148. The positioner flange 154 engages the end face of a second counterbore 156 in the connector 46.

Another element of the inventive gun 20 is the trigger assembly 26. As best shown in FIGS. 1 and 2, the trigger assembly 26 includes a finger engaging portion 164, a pair of connector stubs 166 on the ends of a pivot pin 168 and a pair of spaced apart legs 170. The trigger has a ring 172 positioned by a shelf 173 disposed below a pair of notches 174 on a lower portion of the housing 52. Each of the legs 170 includes a recess 176 having an opening 178 therein. In use, a pair of connector stubs 180 formed on the forward end 182 of the yoke 48 position the yoke with respect to the trigger. The nose or forward end 182 of the yoke is thus held captive relative to the recess in the trigger, and the innate resiliency of the yoke maintains engagement of the trigger 26 and the yoke 48 until it is desired to remove them, in which case the legs 184 of the yoke 48 may be pried or wedged slightly apart. A yoke cross member 186 includes a boss 188 having a countersink or pocket therein for accommodating the Circlip 162 and the washer 163 fitted to the end 160 of the operating rod 40.

Figure 6:
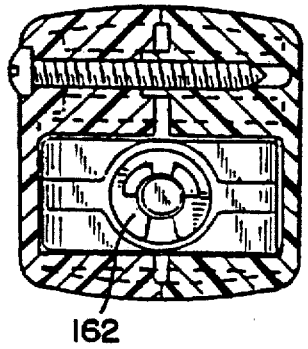
FIG. 6 is a vertical sectional view taken along lines 6—6 of FIG. 2 and showing the arrangement of certain portions of the housing and the connector serving to associate the trigger operated yoke with the end of the valve stem.

Referring again to the valving rod 40, this element further includes an elongated stem portion 158 which extends from the valve head portion 122 to a rear end portion 160 having a groove for reception of a snap ring 162 (FIG. 6) such as a "Circlip" or "Truarc" retainer and optionally, a load-distributing washer 163.

Referring now to the assembly and operation of the inventive gun 20, only a few simple steps are required, assuming that the various components have been manufactured and are in the form illustrated in FIGS. 1–6, for example.

Once the housing 52 and the cover 54 have been formed, the sleeve 38 is secured to the connector 46. Thereupon, the trigger 26 is positioned with its legs 170 lying on either side of the sleeve 38, and the connector stubs 180 on the forward ends of the yoke legs 184 are engaged with the openings 178 in the trigger leg recesses 176. This locates the yoke cross member behind the rear end of the connector 46.

Next, the O-ring positioner 148 is placed within the counterbores in the connector 46 as explained above and retained there by slight dimensional interference. The valving rod 40 is assembled by positioning the guide 42 against the head portion 122 of the valve. The spring 44 is positioned over the shank 138 of the guide 42 and the spring seat 142 is positioned over the rod 40 with the shank portion 140 within the spring 44. The O-ring 152 is then positioned on the rod 40 against the flange portion 144 of the spring seat 142 where it momentarily retains all components on the rod 40. The subassembly of parts from the rod 40 through O-ring 152 is then inserted through the openings in the connector 46 and the cross member 186 of the yoke 184. Then, the washer 163 is placed over the stem end 160 and the snap ring 162 locked in place. With the assembly pressure being released, the subassembly thus formed is placed in the housing 52.

This involves aligning and registering the stubs 166 of the trigger legs into the openings in the bosses 71 in the housing and the cover, which is secured by the screws 56.

At this point, the conduit 30 may be inserted from the bottom of the hand grip 26 and the fitting 31 manipulated in order to screw the upper end portion 84 of the conduit 30 into the connector 46. This joint is secured by threading augmented with a sealant.

This leaves the threaded end 96 of the sleeve 38 extending outwardly of the collar 64. The nozzle 36 is inserted in the sleeve opening 108 and pushed until the flange shoulder 102 bottoms out. Then, the nozzle cover 32 is screwed into place using hand tightening only. With the gun being assembled as described, it is ready for operation.

While all the reasons for the success of the gun of the invention are not understood with certainty, it is believed that the relatively direct flow path and the use of a nozzle with an integral valve seat contribute to the success of the invention. The water flows from the conduit through the connector and axially along the sleeve, coursing through the passages in the valving rod guide. This guide serves the purpose of centering the rod and precisely aligning it within the flow passage in the nozzle and yet does not block off the passage or create turbulence in the flow. The water passes directly around the valve head and through the annular frustoconical space between the valve seat and the head, and directly out the nozzle opening or flow passage.

In prior art constructions, it was common for the valve arrangement to require a double reversal of flow within the gun. In other words, the water was required to flow past the valve seat back towards the valve head and again change directions to escape through the outlet passage. These difficulties are overcome with the present invention which, in spite of working with high pressures and high temperatures, is extremely reliable in use. The provision of the insulating air space 78 is very advantageous insofar as reducing or eliminating the creation of high temperatures on the handle. The comfort and safety of this feature are important, particularly where the gun is to be used over an extended time period.

While the materials used to make the inventive product may be of different kinds, it is presently preferred to make the internal metal parts from stainless steel. The housing and cover are preferably made from a tough injection molded plastic and the containment sleeve and conduit are also preferably made from stainless steel, usually seamless tubing. The connector 46 is preferably a forged steel piece. Plastic materials that are the same or different from those used to make the housing may be used to form the trigger assembly and the yoke from by injection molding. The outer plastic portion of the nozzle cover is also preferably made from a plastic material, with the insert portion thereof preferably being made from brass.

Referring to an optional feature, it will be noted that there are a plurality of notches 174 in a lower surface portion of the housing just above the point at which the handle 26 joins the body 22. A ring 172 supported by a small shelf 173 remains in a near horizontal position from which the ring can be simply lifted up slightly and engaged in one of the notches 174 in order to lock the gun in an "on" position. Re-pulling the trigger to a farther back position allows the ring to drop out of engagement with the notch by gravity to release the ring from holding the trigger. A trigger stop in a form different than the ring 172 may be used.

Guns made according to the principles just described have proven advantageous and desirable in use having a number of novel advantages and characteristics including those here and pointed out and others which are inherent in the invention. A preferred embodiment of the invention having been described by way of example, it is understood that various modifications and changes to the described form of construction will be apparent to those skilled in the art and it is anticipated that such modifications may be made without departing from the spirit of the invention or the scope of the appended claims.

I claim:

1. A high pressure industrial washdown gun for applying water to an area to be washed, said gun comprising, in combination, a body having a hand grip portion, a trigger, a flow control valving system, and a conduit for directing water from a supply line to the interior of said gun body, said valving system comprising, in combination, a water impermeable containment sleeve, a connector having its outlet end affixed in water-tight relation to the rear end of said containment sleeve and its inlet end affixed to said conduit in water-tight relation, a nozzle assembly secured to the forward end of said containment sleeve, said nozzle assembly including a body portion having a central water flow passage extending therethrough, a tapered annular seat surrounding said flow passage and forming an entry to said water flow passage, and a seal providing a liquid-tight connection between said containment sleeve and said nozzle, a valving rod disposed in part within said containment sleeve, said valving rod including a nose portion adapted to cooperate with portions of said flow passage to form a desired flow pattern, an enlarged diameter head having a frustoconical, annular sealing surface cooperating in use with said nozzle seat to form a flow control valve, a portion for receiving and positioning a valving rod guide, and an elongated stem including an end portion extending through an opening in a portion of said connector, said valving rod guide having one portion surrounding said guide receiving portion of said valve stem and other, circumferentially spaced apart portions received in slidable contact within said containment sleeve and arranged so as to provide plural spaced apart axial flow water passages lying between said valve stem and said containment sleeve, a return spring biasing said valving rod toward a closed position thereof and a valving rod actuator forming an operative connection between a portion of said trigger and a portion of said valving rod, whereby moving said trigger causes said valving rod to move from a closed position wherein said head sealing surface and said nozzle seat are engaged, to an open position allowing water flow through said nozzle flow passage and to a tangent area.

2. A washdown gun as defined in claim 1 wherein said hand grip portion is hollow, said conduit is disposed within said hand grip and an air space is provided between the inner surface of said hand grip and the outer surface of said conduit to provide thermal insulation for said handle.

3. A washdown gun as defined in claim 1 wherein said body portion of said nozzle assembly is made from a single piece of plastic material.

4. A washdown gun as defined in claim 3 wherein said nozzle assembly further includes a groove and an O-ring therein for creating said liquid-tight connection between said sleeve and said nozzle.

5. A washdown gun as defined in claim 1 wherein said valving rod is made from a hard metal.

6. A washdown gun as defined in claim 1 wherein said portion of said valving rod adapted to receive and position said valving rod guide includes an enlarged diameter portion of said rod and a radial shoulder also forming a part of said valve head.

7. A washdown gun as defined in claim 1 wherein said valving rod guide comprises a spider element having a tubular central portion and plural radially outwardly extending vanes, each having an outer edge engaging an inner surface of said containment sleeve in a guiding relation.

8. A washdown gun as defined in claim 1 wherein said operative connection between said portion of said trigger and said portion of said valving rod comprises a trigger yoke having its forward end pivotally to connected portions of said trigger, and its rearward portion including a cross member having an opening therein and a pocket surrounding said opening for receiving a retainer for the end portion of said valving rod.

9. A washdown gun as defined in claim 1 which includes a resilient seal ring and a seal positioner disposed in a portion of said connector opposite the outlet end of said connector, said connector further including a counterbore for positioning said seal positioner.

10. A washdown gun as defined in claim 1 wherein said gun body comprises a main body portion including said hand grip portion and a cover portion, said hand grip and said body and cover being made from a synthetic plastic material.

* * * * *